United States Patent [19]

Barker

[11] Patent Number: 4,829,952

[45] Date of Patent: May 16, 1989

[54] POPPET VALVE LASH CAP ASSEMBLY

[76] Inventor: David A. Barker, 11262 Yearling St., Cerritos, Calif. 90280

[21] Appl. No.: 136,718

[22] Filed: Dec. 22, 1987

[51] Int. Cl.[4] ..... F01L 3/10

[52] U.S. Cl. ..... 123/90.67; 123/188 VA; 251/337

[58] Field of Search ..... 123/90.67, 188 VA, 188 AF, 123/188 SA, 188 SB, 188 SC; 251/337

[56] References Cited

U.S. PATENT DOCUMENTS

| | | | |
|---|---|---|---|
| 1,605,399 | 11/1926 | Fornaca | 251/337 X |
| 3,043,284 | 7/1962 | Gundstrom | 123/90.67 X |
| 3,077,874 | 2/1963 | Bush | 123/90.67 |
| 3,164,366 | 1/1965 | Tauschek | 123/188 VA |
| 3,978,830 | 9/1976 | Toth, Jr. | 123/90.67 |
| 4,180,030 | 12/1979 | McWhirter | 123/90.67 |

FOREIGN PATENT DOCUMENTS

| | | | |
|---|---|---|---|
| 0511286 | 5/1952 | Belgium | 123/90.67 |
| 2186057 | 8/1987 | United Kingdom | 123/188 SC |

*Primary Examiner*—Willis R. Wolfe

*Attorney, Agent, or Firm*—Fulwider, Patton, Rieber, Lee & Utecht

[57] ABSTRACT

A means of providing a lash cap for the poppet valve of an internal combustion engine. The lash cap is positively retained on the distal end of the valve stem by retaining an annular projection on the lash cap within a mating cavity in otherwise conventional valve keepers. Alternatively, the lash cap is retained by a projection on the interior of the valve keeper which mates with a cavity in the lash cap.

13 Claims, 1 Drawing Sheet

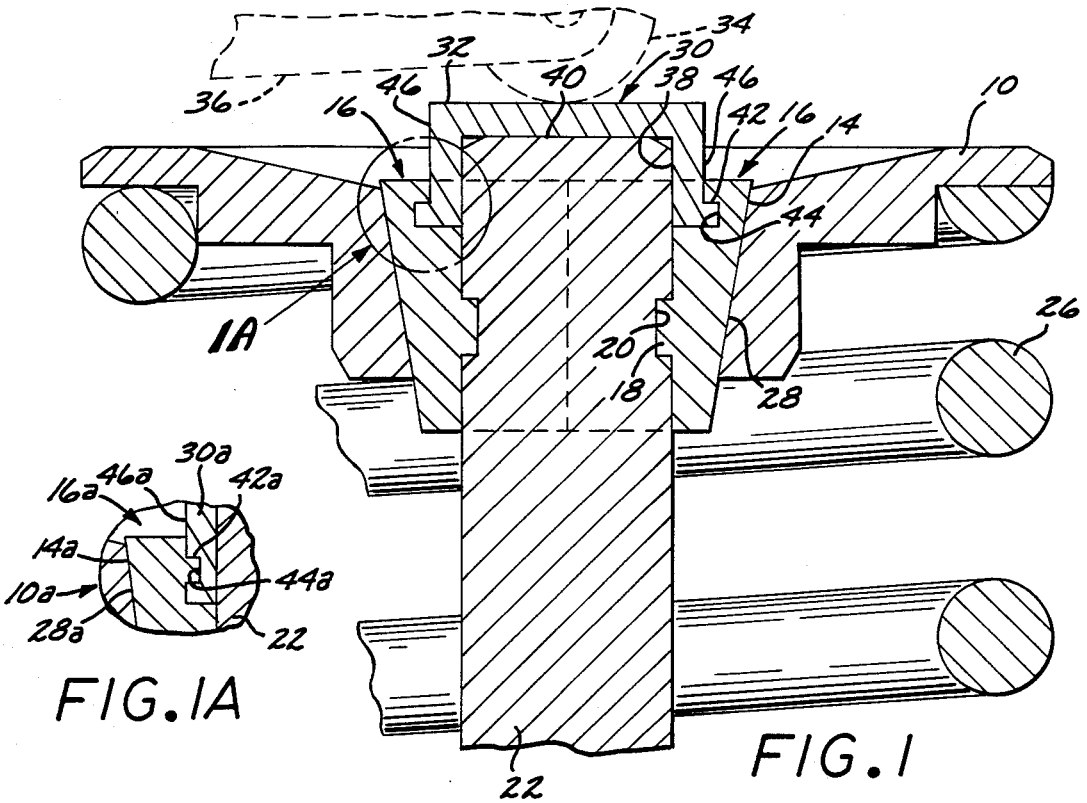
FIG. 1A
FIG. 1
FIG. 2
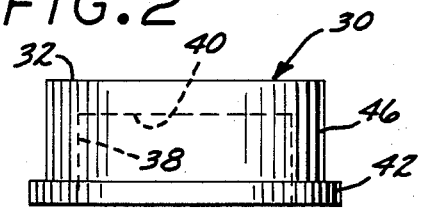
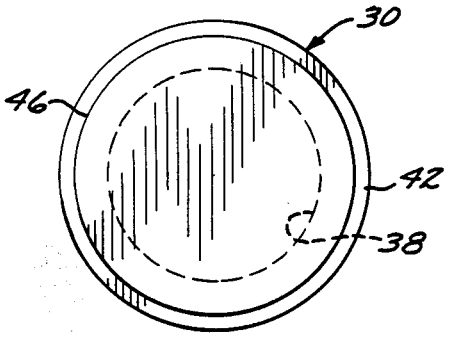
FIG. 3
FIG. 4
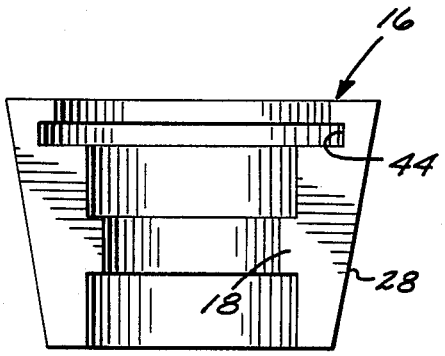
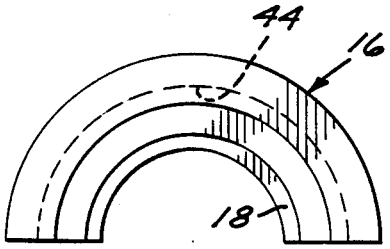
FIG. 5

POPPET VALVE LASH CAP ASSEMBLY

BACKGROUND OF THE INVENTION

1. Field Of The Invention

This invention relates to the valve train of an internal combustion engine and specifically to a lash cap for the poppet valve in a four stroke engine.

2. Description Of The Prior Art

Four stroke internal combustion engines have two or more intake and exhaust valves that are frequently configured in the shape of a poppet valve in which a mushroom shaped head is attached to a long stem. The valve stem fits within a valve guide placed or formed in the cylinder head and terminates in a groove or grooves at its distal tip. These grooves are used to retain conical valve keepers that are used to lock a valve spring retainer against the force of a valve spring serving to close the valve. The valve is opened through the use of a rocker arm or follower that is remotely operated by a camshaft designed to time the opening and closing of the valve to provide the appropriate performance parameters for the engine.

Modern high performance engines incorporate valves that are made of a variety of materials, including titanium, to provide the appropriate combination of strength, lightness and resistance to heat necessary for long life and high performance. However, when materials such as titanium are used for such valves, they may be damaged when pushed on by the valve actuating mechanism, since it is not easily or simply accomplished to provide a hardened surface on the distal end of the valve itself, as is the case when steel valves areas used. For this reason, lash caps have been developed to be placed over the distal end of the valve stem. These lash caps are made of hardened steel and provide a larger area upon which the valve actuating mechanism may push and protect the relatively soft tip of the distal end of the valve stem. However, such lash caps could sometimes become dislodged when the engine was operated at very high speed, thereafter failing to protect the distal end of the valve stem and also distributing a loose foreign object in the engine that might cause considerable damage unless the engine was stopped.

Previous methods to prevent the dislodging of lash caps included increasing the depth of the cup fitting over the distal end of the valve to thereby make it harder for the lash cap to become dislodged or increasing the diameter of the lash cap to make it less likely that it would cock and come loose from the distal end of the valve stem. However, both of these methods did not result in a positive retention of the lash cap in the valve train assembly and further unnecessarily added to the weight of the valve train, an undesirable effect in high performance applications.

There remains, therefore, a need for a means of positively retaining lash caps for the distal end of poppet valves in high performance applications that is simple, reliable, relatively lightweight and not prone to failure at high speed.

SUMMARY OF THE INVENTION

While the previous methods of proving lash caps for high performance valve trains have been partially successful, none of these methods provide a means of positively locking the lash cap firmly over the distal end of the valve stem and still maintaining light weight for the valve train. The present invention provides a solution to this problem without additional parts and is relatively simple to manufacture and install, requiring no special tools or installation procedures other than those normally used to assemble such a valve train.

The present invention utilizes a hat shaped lash cap in which a projection perpendicular to the center line of the lash cap and the valve mates with a corresponding cavity formed in the valve keepers to prevent movement of the lash cap once the keepers and valve retainer assembly are installed at the distal end of the valve. No alteration is necessary to the valve spring retainers or the valves in order to utilize the invention and the modification to the valve keepers is relatively minor.

In practice, the cavity formed in the valve keeper is large enough to prevent binding of the lash cap in the valve keepers when it is installed, but is still sufficient to prevent the lash cap from being dislodged short of the total disintegration of the valve train. The valve keeper is firmly wedged against the valve stem by a conventional valve spring retainer and this wedging action forces the valve keepers in positive contact with the valve stem and also retains them in that position by a combination of a projection on the inside of the valve keeper and a groove cut into the stem. This wedging action is provided by mating tapers on the outside of the keepers and on the inside of the retainer, with the force to cause the wedging being provided by the valve string acting against the retainer. The result is an extremely rigid, strong and dimensionally stable assembly that locks the lash cap into a position from which it may not be dislodged.

Those skilled in the art will appreciate that the invention may also be configured with a cavity in the exterior wall of the lash cap and a mating projection on the interior of the keepers, the projection and cavity serving to retain the lash cap in the distal end of the valve in a manner similar to the apparatus described above.

Other advantages and benefits of the present invention will become apparent to those skilled in the art from the following detailed description, which shows, by way of example, the operation of the invention.

BRIEF DESCRIPTION OF THE DRAWINGS

FIG. 1 is an enlarged, fragmentary, sectional transverse view of a poppet valve lash cap and keeper embodying the novel features of the present invention in combination with valve gear;

FIG. 1A is an enlarged, fragmentary, transverse sectional view of the present invention taken substantially from the circle 1A of FIG. 1;

FIG. 2 is an enlarged side elevational view of the poppet valve lash cap of the present invention;

FIG. 3 is an enlarged top plan view of the present invention;

FIG. 4 is an enlarged side elevational view of the keeper of the present invention; and FIG. 5 is an enlarged top plan view of the keeper of the present invention.

DESCRIPTION OF THE PREFERRED EMBODIMENT

As shown in the exemplary drawings, the present invention is embodied in a means for attaching a lash cap 30 onto the distal end of the valve stem 30 by interlocking the projection 42 in lash cap cavity 44 in valve keeper 16 which is itself affixed to the valve stem. In accordance with the prior art, a cup shaped lash cap was placed over the distal end of the valve stem. The lash cap was not affixed to the distal tip of the valve stem, so it could, and unfortunately sometimes would, be dislodged by slipping off the distal end of the valve stem when the engine was operated at high speed, due to the inability of the actuation valve gear to accurately follow the profile of the camshaft, a condition generally referred to as "valve float". If so dislodged, the lash cap would cease to protect the distal tip of the valve stem and might also act as a loose foreign object to disrupt the functioning of the internal combustion engine in which it was located.

Preferably, the lash cap is a cup-like object, the base and inner walls of which define a cavity of approximately the same shape and size as the distal tip of the valve stem. A lash cap thus configured can be placed over the distal tip of the valve stem, interposing the base of the cup-like lash cap between the distal tip of the valve stem and any object such as a roller follower of a rocker arm which would otherwise contact the valve stem, thereby causing undesirable wear. Such a lash cap is particularly beneficial if the valve is formed of a relatively soft but light material such as titanium, which is often used in high performance applications.

FIG. 1 illustrates the basic arrangement of the invention in combination with conventional valve gear of the type found in high speed internal combustion engines. The valve gear of conventional engines utilizes a spring retainer 10 that incorporates a spring mounting surface 12 and a tapered bore 14 designed to receive the matching taper 28 of valve keeper 16. Valve keeper 16 incorporates a projection 18 formed therein and mating with a grove 20 formed near the distal end of valve stem 22. Keepers 16 are made in two parts, so that prior to assembly, they may be placed on either side of valve stem 24 after retainer 10 has been compressed against the spring 26 to allow sufficient space to install the keepers. Thereafter, spring retainer 10 is released and tapered bore 14 presses up against the tapered exterior 28 of keeper 16 to lock them in place in combination with projections 18 extending into groove 20 in valve 22.

A lash cap 30 according to the present invention consists of an essentially hat shaped member defining a top surface 32 that was designed to be in contact with the valve operating mechanism such as roller follower 34 of rocker arm 36, said top surface being hardened to prevent unnecessary wear under high force and repeated actuations such as those experienced in high speed internal combustion engines. Lash cap 30 further includes an internal cavity 38 designed to mate with the distal surface 40 of valve 22. The lash cap 30 according to the present invention further includes a projection 42 essentially perpendicular to the longitudinal axis of valve 22 and lash cap 30 which mates with a cavity formed in keeper 16 to receive said projection. In practice a small amount of clearance, typically on the order of 15 thousandths of an inch (0.015") in the direction parallel to the axis of the valve and 5 thousandths of an inch (0.005") in the radial direction is provided between the exterior surfaces of the lash cap and the keeper to insure reliable operation of the valve keeper assembly in retaining the valve retainer. Typically, the clearance between the surfaces of the internal cavity 38 in lash cap 30 and distal surface 40 of valve stem 20 is on the order of 1 thousandth of an inch (0.001"). These clearances provide ease of assembly, prevent binding of the lash cap after installation and also help insure reliability of the valve keeper mechanism.

FIG. 1(*a*) illustrates an alternative embodiment of the invention in which lash cap 30*a* external surface 46*a*, has a cavity 42*a* which mates with a projection 44*a* in keeper 14*a*, said cavity and projection serving to retain said lash cap 30*a* within said keeper and valve retainer assembly. Similarly to the embodiment illustrated in FIG. 1, tapered surface 28*a* of keeper 16*a* mates with tapered surface 14*a* of retainer 10*a* to lock said keepers to said valve, thus retaining lash cap 30*a* on the distal end of valve 22*a* This embodiment and variations of it may be preferable for some applications, since it simplifies the machinery of both the keepers and the lash cap, the former by making the projection that fits in the locking groove of the valve and the locking groove in the lash cap extend in the same direction and the latter by reducing the overall diameter of the lash cap and reducing the amount of machining required for the lash cap.

FIG. 2 illustrates a lash cap configured according to a preferred embodiment of the present invention. Such a lash cap 30 would preferably be made of high tensile steel that is hardened after machining to provide appropriate wear characteristics in high speed operation of internal combustion engines. Lash cap 30 has machined on it a top surface 32 designed to receive the force from the valve train which would otherwise be directed against the distal end of the valve. Cavity 38 is machined on the interior surface of lash cap 30 to receive the distal end of the valve and to fit thereon. The exterior surface of lash cap 30 is machined to fit the corresponding cavity 44 in keeper 16 designed to receive the lash cap.

FIG. 3 is a top elevational view of lash cap 30, illustrating the internal surface of cavity 38 which receives the valve stem. The external projection 42 is seen to be an annular ledge projecting perpendicularly to the centerline of the valve and keeper. While an annular projection is illustrated, it will be appreciated that other projections which accomplish the same purpose and are received in a cavity in the keepers are also contemplated by the invention.

FIG. 4 illustrates a keeper 16 configured according to the present invention. Such a keeper is formed in the shape of an inverted truncated cone with the angled wall 28 tapered to receive the matching taper in retainer 10. The projection 18 in keeper 16 mates with the corresponding groove in valve 22 to retain the keepers after assembly. Cavity 44, formed in keeper 16, is designed to receive lash cap projection 42 and lash cap exterior cylindrical surface 46 to provide thereby a positive retention of the lash cap 30.

FIG. 5 illustrates a top view of one of a pair of keepers 16 showing the relationship of the various surfaces formed on the interior of the keeper to retain the keeper against the valve and the lash cap within the keeper. Here, projection 18 is illustrated to form the farthest interior surface of the keeper, while cavity 44 is formed in the direction opposite of that of the projection used to lock the keeper. While a number of surfaces thus may be formed in the keeper to provide for its functions, such keepers are relatively easily fabricated using modern machine tool techniques and the configuration of the keepers according to the present invention does not represent any substantial increase in price or complexity compared to valve train assemblies previously used.

From the above, it may be seen that the present invention provides for a distinct improvement over previous methods of lash cap retention in that the present invention positively locates the lash cap assembly within the keepers, thereby preventing any possibility of the lash cap being dislodged short of total disintegration of the valve train. Furthermore, the invention is simple, easily implemented using normal machining techniques and assembly is relatively simple. For example, to assemble a valve assembly configured according to the invention, one merely compresses the valve spring 26 by pressing on the top of retainer 10 with a suitable tool. Once the retainer has been depressed a sufficient distance, the lash cap 30 is placed over the distal end of the valve stem and the keepers 16 are inserted around the lash cap with their internal projections 18 locking into the groove 20 in the valve. The valve retainer 10 is then slowly released, allowing it to move upward, wedging the keepers between the retainer and the valve stem and locking the keepers against the valve stem by the provided combination of projection 18 and groove 20 in valve 22 and at the same time locking lash cap 30 into keepers 16 by means of projection 42 on lash cap 30 and cavity 44 in keeper 16.

The present invention not only solves a number of problems with previous methods of retaining lash caps but also accomplishes this desirable result utilizing a simple, robust and easily installed assembly. While the invention is described and illustrated with respect to the preferred embodiment shown, other features and benefits of the invention will be apparent to those skilled in the art. Therefore, changes and modifications may be made therein without departing from the scope and spirit of the invention, which should only be limited according to the appended claims.

I claim:

1. An improved poppet valve lash cap assembly of the type in which a cup shaped lash cap is placed over the distal end of the poppet valve stem to provide improved wear characteristics, said poppet valve assembly further incorporating valve retainers and valve keepers, wherein the improvement comprises;

a radial projection on the exterior of said lash cap, said projection extending outward in an essentially perpendicular direction from the common axis of said cap and said valve stem; and a mating internal cavity in the valve keepers of said valve assembly, wherein said projection and said cavity cooperate to provide the retention of said cap over the distal end of said valve after installation of said keepers.

2. The lash cap assembly of claim 1 wherein said projection further comprises;

a projection which is interrupted about the periphery of said projection.

3. A lash cap assembly for a poppet valve assembly of the type incorporating a valve retainer and valve keepers, said lash cap comprising:

a cup shaped lash cap with an outer wall and an inner wall, said inner wall mating with the distal end of said poppet valve;

a non-linear surface configuration on said outer wall;

a plurality of valve keepers with essentially conical outer surfaces and an inner surface, said keepers having a distal end near the distal end of said valve and a proximal end in opposition thereto;

the distal end of each valve keeper defining a mating surface configuration to that on said lash cap and interlocking therewith;

whereby said surface configurations cooperate to retain said lash cap on said distal end of said valve.

4. The lash cap assembly of claim 3 in which said surface configuration on said lash cap is a projection.

5. The lash cap assembly of claim 4 wherein said projection is a ledge circumscribing the exterior surface of said lash cap.

6. The lash cap assembly of claim 4 wherein said projection is a plurality of projections located upon the exterior surface of said lash cap.

7. The lash cap assembly of claim 3 wherein said surface configuration of said lash cap is a cavity.

8. The lash cap assembly of claim 7 wherein said surface configuration in said keepers is a projection mating with said cavity in said lash cap.

9. An improved lash cap for a poppet valve of the type incorporating keepers keyed to the distal end of said poppet valve, said keepers retained on said valve by the wedging action between an external taper on said keepers and a mating taper on a valve retainer, said taper increasing in diameter in a direction toward the distal end of said valve, said valve retainer retaining a valve spring serving to force said valve to a closed position, whereby the improvement comprises:

a non-linear surface configuration on an external surface of said lash cap; and a mating surface on said keepers, whereby said surfaces serve to retain said lash cap on the distal end of said poppet valve.

10. The improved lash cap assembly of claim 9, wherein said non-linear surface configuration on said lash cap comprises an outward projection in a direction approximately perpendicular to the common axis of said lash cap and said valve.

11. The improved lash cap assembly of claim 10, wherein said mating surface configuration on said keepers comprises a cavity formed on a surface of said keepers facing said lash cap.

12. The improved lash cap assembly of claim 9, wherein said non-linear surface configuration on said lash cap comprises at least one cavity formed in said lash cap.

13. The improved lash cap assembly of claim 12 wherein said mating surface configuration on said keepers comprises a projection formed on a surface of said keepers facing said lash cap.

* * * * *